US009091274B2

(12) United States Patent
Galeotti

(10) Patent No.: US 9,091,274 B2
(45) Date of Patent: Jul. 28, 2015

(54) DEVICE AND METHOD FOR DETECTING A SURGE IN A COMPRESSOR AND RELOCATING A SURGE MARGIN

(75) Inventor: Daniele Galeotti, Florence (IT)

(73) Assignee: Nuovo Pignone S.P.A., Florence (IT)

( * ) Notice: Subject to any disclaimer, the term of this patent is extended or adjusted under 35 U.S.C. 154(b) by 707 days.

(21) Appl. No.: 13/217,608

(22) Filed: Aug. 25, 2011

(65) Prior Publication Data

US 2012/0048387 A1 Mar. 1, 2012

(30) Foreign Application Priority Data

Aug. 31, 2010 (IT) ..... CO2010A0048

(51) Int. Cl.
*F04D 27/02* (2006.01)
*F04D 27/00* (2006.01)

(52) U.S. Cl.
CPC ..... *F04D 27/0207* (2013.01); *F04D 27/001* (2013.01); *F04D 27/0223* (2013.01)

(58) Field of Classification Search
CPC ..... F04D 27/0207; F04D 27/001; F04D 27/0223
USPC ..... 415/13, 26, 27, 52.1, 58.4; 416/35, 61
See application file for complete search history.

(56) References Cited

U.S. PATENT DOCUMENTS 2,737,962 A 3/1956 Paul Almeras
4,164,034 A 8/1979 Glennon et al.
4,618,856 A * 10/1986 Antonazzi ..... 340/626
5,306,116 A * 4/1994 Gunn et al. ..... 415/27
5,541,857 A 7/1996 Walter et al.
5,709,526 A * 1/1998 McLeister et al. ..... 415/1
5,791,712 A 8/1998 Hawn
5,798,941 A * 8/1998 McLeister ..... 700/282
6,317,655 B1 11/2001 Khots et al.
2002/0139180 A1 10/2002 Xiong et al.

(Continued)

FOREIGN PATENT DOCUMENTS

CN 1601111 A 3/2005
CN 1820133 A 8/2006

(Continued)

OTHER PUBLICATIONS

Italian Search Report and Written Opinion issued in connection with IT Application No. CO2010A000048, Apr. 5, 2011.

(Continued)

*Primary Examiner* — Edward Look
*Assistant Examiner* — Danielle M Christensen
(74) *Attorney, Agent, or Firm* — GE Global Patent Operation

(57) ABSTRACT

Methods, systems and controllers for detecting a surge event based on pattern of evolution of a discharge pressure of a compressor, and for relocating a surge margin relative to a surge parameter value recorded at the beginning of the surge event are provided. A controller has an interface configured to receive values of the discharge pressure from a compressor, and to output signals and alarms, a surge event detection unit connected to the interface and configured to detect a surge event in the compressor based on evolutions of the discharge pressure, a rate of the discharge pressure and a rate change of the rate, and a surge margin relocation unit connected to the surge event detection unit and the interface, and configured to relocate a surge margin relative to a surge parameter value recorded at a beginning of the surge event.

18 Claims, 15 Drawing Sheets

(56) References Cited

U.S. PATENT DOCUMENTS

| | | | |
|---|---|---|---|
| 2004/0193355 | A1 | 9/2004 | Faymon et al. |
| 2009/0312930 | A1 | 12/2009 | Nakakita et al. |

FOREIGN PATENT DOCUMENTS

| | | | |
|---|---|---|---|
| CN | 101178074 | A | 5/2008 |
| JP | H08503042 | A | 4/1996 |
| WO | 2007122499 | A1 | 11/2007 |

OTHER PUBLICATIONS

Unofficial English Translation of Chinese Office Action and Search Report issued in connection with corresponding CN Application No. 201110268657.2 on Dec. 31, 2014.

* cited by examiner

DEVICE AND METHOD FOR DETECTING A SURGE IN A COMPRESSOR AND RELOCATING A SURGE MARGIN

BACKGROUND OF THE INVENTION

1. Field of the Invention

Embodiments of the subject matter disclosed herein generally relate to methods and devices that relocate a surge margin after occurrence of a surge event is detected based on pattern recognition in an evolution of a discharge pressure.

2. Description of Related Art

Centrifugal compressors are a class of radial-flow work-absorbing turbomachinery. In a centrifugal compressor, the pressure is increased by adding kinetic-energy/velocity to a continuous flow of fluid through rotation of a rotor or an impeller of the compressor. Centrifugal compressors are frequently used in pipeline transport of natural gas to move the gas from a production site to consumers, in oil refineries, refrigeration systems, gas turbines, etc.

Centrifugal compressor's operation may be affected by the occurrence of a surge. Pressure of a flow of fluid passing through the compressor increases from a surge pressure at the input of the compressor, to a discharge pressure at the output of the compressor. A surge phenomenon occurs when the compressor cannot add enough energy to overcome the system resistance, which results in a rapid flow and discharge pressure decrease. The surge may be accompanied by high vibrations, temperature increases and rapid changes in the axial thrust. These effects may damage the compressor. Most systems including compressors are designed to withstand occasional surging. However, repeated and long lasting surges may result in catastrophic failures.

The system operation during a surge event is unstable. Therefore, engineers try to operate compressors away from the compressor's stability limit, by adjusting a ratio of the pressures of fluid input into and discharged from the compressor, the fluid flow or other parameters that may be controlled. A surge margin provides a measure of how close an operating state of the compressor is to a surge state. Various parameters may be used for evaluating the surge margin. For example, a surge margin may be a ratio of a fluid flow input into the compressor which engineers consider safe (i.e., no surge is expected to occur) and a surge fluid flow at which a surge is likely to occur, all other operating conditions (e.g., a ratio of a surge pressure and a discharge pressure) except the fluid flow being the same.

FIG. 1 represents a diagram of a conventional system 1 including an expander 10 and a compressor 20. The conventional system 1 includes an anti-surge flow recirculation loop 30 providing a flow path from an output 32 of the compressor 20 to an input 34 of the compressor 20. Along the anti-surge flow recirculation loop 30 are located a surge detector 40 and an anti-surge valve 50. The anti-surge flow recirculation loop 30 may also include a gas cooler 60 and a flow element 70.

Depending on the operating states of the anti-surge valve 50, a gas flow may be recycled from the output 32 of the compressor 20 to the input 34 of the compressor 20. When the detector detects a surge trend, the anti-surge valve 50 is operated to break the surge cycle by adjusting the flow to reverse the surge trend. Conventionally, the anti-surge control and surge detection are independent. The conventional surge detection may only trip the system.

A surge shot is an event characterized by the occurrence of a surge trend. Due to potentially catastrophic effects of a surge event, it is desirable to operate the system with a sufficient surge margin to avoid occurrence of any surge event.

The surge detector 40 may detect an occurrence of a surge trend by monitoring a discharge pressure ($p_d$) at the output 32 of the compressor 20. Conventionally, a surge trend is detected when the discharge pressure decreases rapidly (i.e., based on a first order derivative relative to time of the discharge pressure). A first order derivative of the discharge pressure is calculated mechanically in the surge detector 40 in FIG. 1, but it may alternatively be obtained electronically based on signal processing in an electronic surge detector described below relative to FIG. 2.

FIG. 2 illustrates a block diagram of a conventional electronic surge detector 100. The discharge pressure (V) is input to the calculation block 110 and to the add/subtract block 120. A time constant (T) is also input to the calculation block 110. The calculation block 110 outputs a value proportional to the discharged pressure (V) obtained using a first order lag filter with time constant T.

The add/subtract block 120 subtracts the discharge pressure from the value output by block 110, and outputs a value (A) that (expressed in Laplace transform nomenclature) is equal to—pdTs/(1+Ts), to the comparison block 130. The comparison block 130 sends a signal to the event counter block 140 if the value (A) received from block 120 is larger than a predetermined value (B), which is separately input to the comparison block 130.

The event counter 140 keeps track of a number of signals, which represent surge shots, received from the comparison block 130 within a predetermined time interval (T3surge), whose value is entered separately to the event counter 140. If two or more surge shots occur during a period equal to the predetermined time interval (T3surge), the event counter 140 outputs an alarm signal. If three or more surge shots occur during a period equal to the predetermined time interval (T3surge), the event counter 140 outputs a trip signal, signaling imminent trip (i.e., shut down) of the system.

The conventional surge detection has the disadvantage that a surge shot detection depends only on an instantaneous discharge pressure slope (i.e., the first derivative of the discharge pressure). However, a discharge pressure versus time pattern typically occurring in after the surge trend has more complex features. For example, after the discharge pressure drops abruptly in a relatively short time a minimum pressure value is reached, and then the discharge pressure increases again. Conventional recognition of this surge pattern is weak because it considers only on the first time derivative of the discharge pressure at the beginning of the surge shot.

Additionally, the conventional system provides no recovery action if the anti-surge controller operates based on an erroneously configured surge line, the only response of the conventional system being tripping of the system. For example, if the margin is set too low with respect to the real surge line, the anti-surge control through the loop 30 cannot maintain a minimum safe flow through compressor and a surge trend cycle may occur at a frequency that depends also on a closure rate of the anti-surge valve 50.

Another disadvantage of the conventional system 1 is that an amplification applied to the time derivative of the discharge pressure is related to the predetermined threshold used for determining the occurrence of a surge shot.

Accordingly, it would be desirable to provide systems and methods that avoid the afore-described problems and drawbacks.

BRIEF SUMMARY OF THE INVENTION

According to one exemplary embodiment, a fluid transport system includes (a) a compressor configured to increase a pressure of a fluid flow passing therethrough, (b) an anti-surge flow recirculation loop configured to selectively redirect a part of the fluid flow passing through the compressor from a discharge output of the compressor to an input of the compressor, and (c) a controller connected to the anti-surge flow recirculation loop and the compressor, and configured (i) to detect a surge event based on an evolution of a discharge pressure of the compressor, a rate of the discharge pressure, and a rate of change of the rate of the discharge pressure, and (ii) to relocate a surge margin characterizing an operation of the fluid transport system, based on a surge parameter value recorded at a beginning of the surge event.

According to one exemplary embodiment, a method for a fluid transport system including a compressor includes (i) detecting a beginning of a surge event based on a rate of a discharge pressure of the compressor and a rate change of the rate of the discharge pressure, (ii) after the beginning of the surge event, monitoring the pressure until the discharge pressure decreases below an expected low discharge pressure value, (iii) after the discharge pressure has decreased below the expected low discharge pressure value, detecting an end of the surge event when the rate of the discharge pressure becomes positive, and (iv) after the end of the surge event, relocating a surge margin based on a surge parameter value recorded at the beginning of the surge event.

According to another embodiment, a controller has (i) an interface configured to receive values of discharge pressure from a compressor, and to output signals and alarms, (ii) a surge event detection unit connected to the interface and configured to detect a surge event in the compressor based on evolutions of the discharge pressure, a rate of the discharge pressure and a rate change of the rate, and (iii) a surge margin relocation unit connected to the surge event detection unit and the interface, and configured to relocate a surge margin relative to a surge parameter value recorded at a beginning of the surge event, after the surge event detector detects a pattern of a surge event in the evolutions.

BRIEF DESCRIPTION OF THE SEVERAL VIEWS OF THE DRAWINGS

The accompanying drawings, which are incorporated in and constitute a part of the specification, illustrate one or more embodiments and, together with the description, explain these embodiments. In the drawings.

DETAILED DESCRIPTION OF THE INVENTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of gas systems including compressors and anti-surge flow recirculation loops. However, the embodiments to be discussed next are not limited to these systems, but may be applied to other systems that require avoiding repeated surge cycles of a turbomachine.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 3:
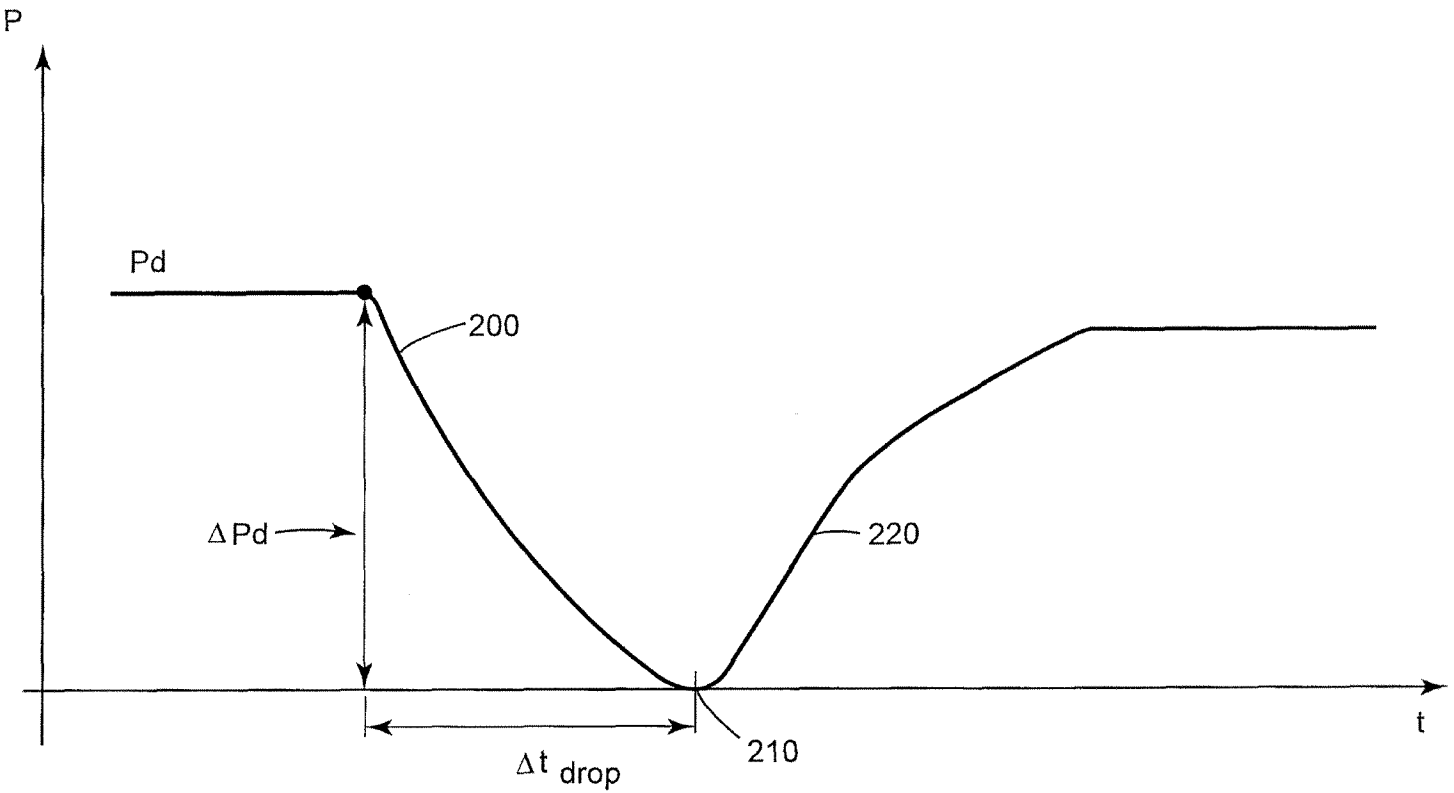
FIG. 3 is a graph of an evolution of the discharge pressure, when a surge trend occurs.

FIG. 3 is a graph of an evolution of a discharge pressure, when a surge trend occurs. In the following description, a surge event designates an evolution after a surge trend is observed. A person of skill in the art understands that the opening of the anti-surge valve reverses the surge trend.

A surge event may be identified based on features of a pattern representing the evolution of the discharge pressure ($p_d$) during a surge event. At a beginning 200 of the surge event, the discharge pressure decreases rapidly. A rate of the discharge pressure increases in absolute value (the actual value being negative since the discharge pressure decreases). A rate change of the rate of the discharge pressure is also increasing in absolute value (the actual value decreases because it is negative).

Thus, during a surge event, a discharge pressure drops with an amount $\Delta p_d$ during a time interval $\Delta t_{drop}$. The amount of pressure drop $\Delta p_d$ may be around a known percentage (e.g., 12%) of the difference between a discharge pressure and a suction pressure (i.e., the pressure at the compressor's intake) at the beginning of the surge. Given the anti-surge flow recirculation loop presence, the discharge pressure is not expected to decrease significantly below a low expected value 210. The time interval $\Delta t_{drop}$ from when the discharge pressure starts dropping until the discharge pressure starts increasing is also usually around a known time value, for example, 2.5 s from when the beginning of the surge event has been observed. If during a predetermined time interval (larger than the known value), the discharge pressure does not fall below a low discharge pressure expected value, the system may consider that no surge event requiring margin relocation has occurred.

After reaching a minimum value, the discharge pressure increases, e.g., 220. When the discharge pressure increases, the rate of the discharge pressure becomes positive.

Figure 4:
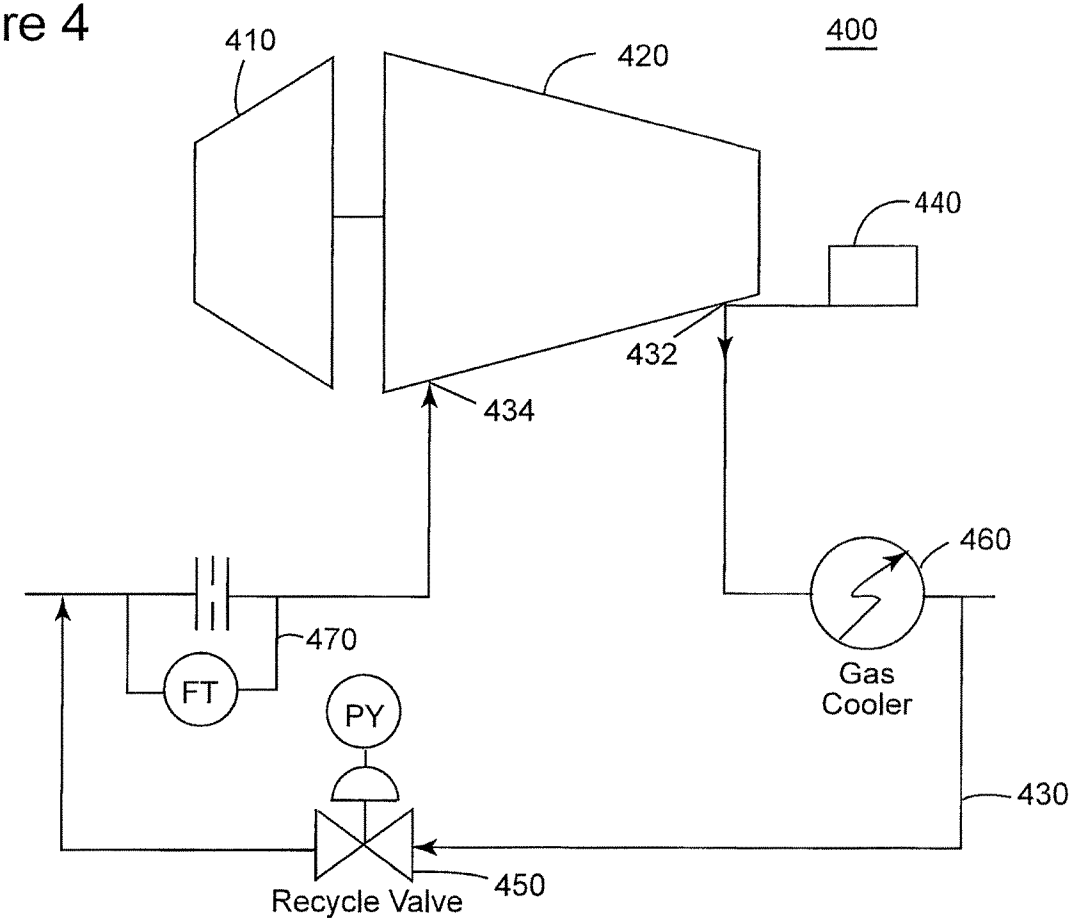
FIG. 4 is a schematic diagram of a system including a compressor according to an embodiment.

FIG. 4 is a schematic diagram of a system 400 including an expander 410 and a compressor 420, according to an exemplary embodiment. The system 400 includes an anti-surge flow recirculation loop 430 providing a flow path from an output 432 of the compressor 420 to an input 434 into the compressor 420.

Based on an evolution of a discharge pressure at the output 432 of the compressor, a controller 440 detects a surge event. The controller 440 may verify multiple features of the discharge pressure evolution. For example, the controller 440 may detect a beginning of the surge event when a rate of the discharge pressure exceeds a predetermined value, falling fast according to a change of the rate of the discharge pressure. Then, the controller 440 may monitor the discharge pressure and the rate of the discharge pressure until the discharge pressure becomes lower than a low expected value. The controller 440 may then detect an end of the surge event when the rate becomes positive. Following a surge event, the controller 440 may output a relocation alarm signal and provide a new surge margin value for operating the compressor.

When a surge trend occurs, an anti-surge valve 450 on the anti-surge flow recirculation loop 430 opens to reverse the surge trend. The anti-surge flow recirculation loop 430 may also include a gas cooler 460 and a flow measurement element 470.

Figure 5:
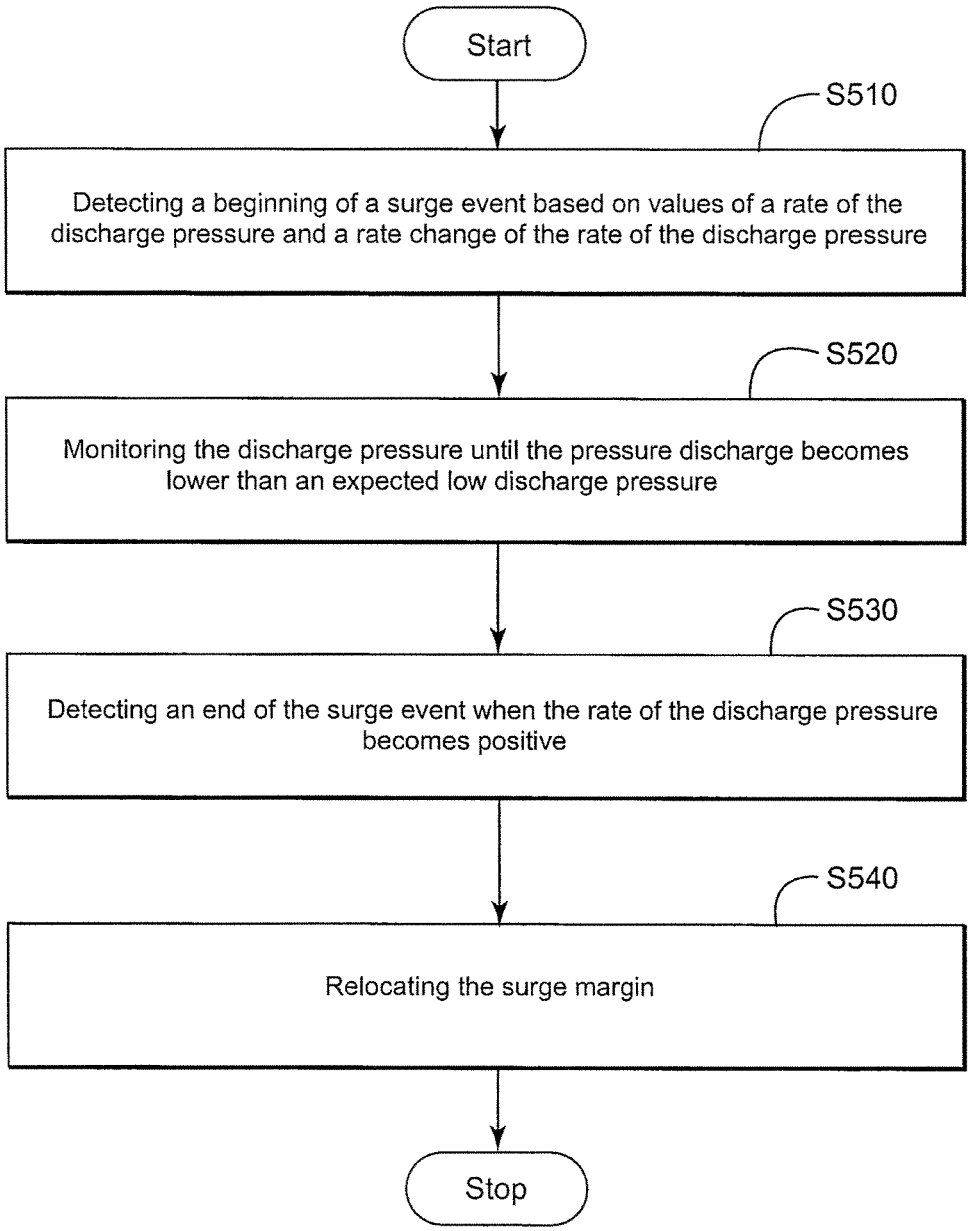
FIG. 5 is a flow diagram of a method for detecting a surge and relocating a surge margin according to an embodiment.

FIG. 5 represents a flow diagram of a method 500 for surge detection and margin relocation according to another embodiment. At step S510, a beginning of a surge event is detected based on values of a rate of the discharge pressure and a rate change of the rate of the discharge pressure. At step S520, the discharge pressure decrease is monitored until the pressure falls below a low expected value. At step S530, an end of the surge event is detected when the rate of the discharge pressure indicates that the discharge pressure increases.

Thus, steps S510, S520 and S530 recognize the discharge pressure evolution during a surge event. At step S540, the surge margin is relocated to avoid recurrence of the surge.

Figure 1:
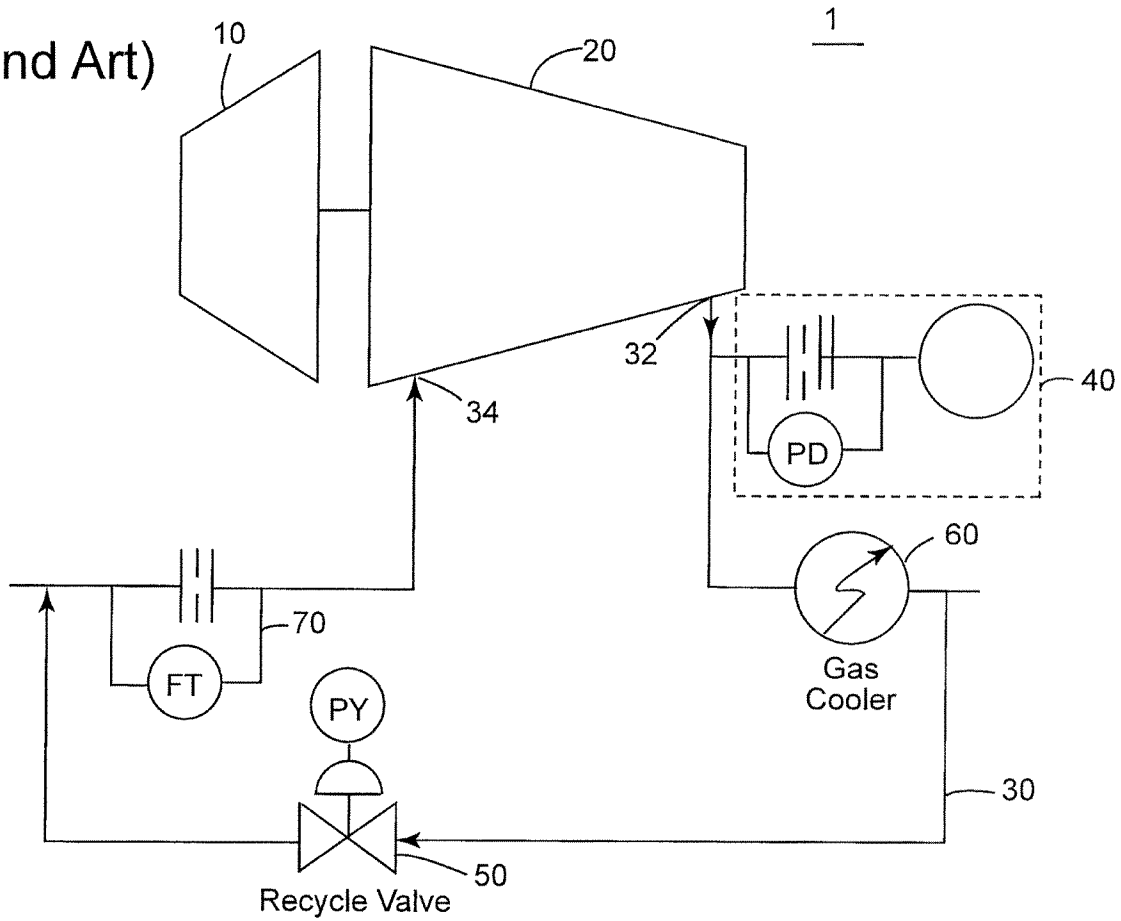
Figure 1 (Background Art)
FIG. 1 is a schematic diagram of a conventional system including a compressor and a mechanical surge detector.
Figure 2:
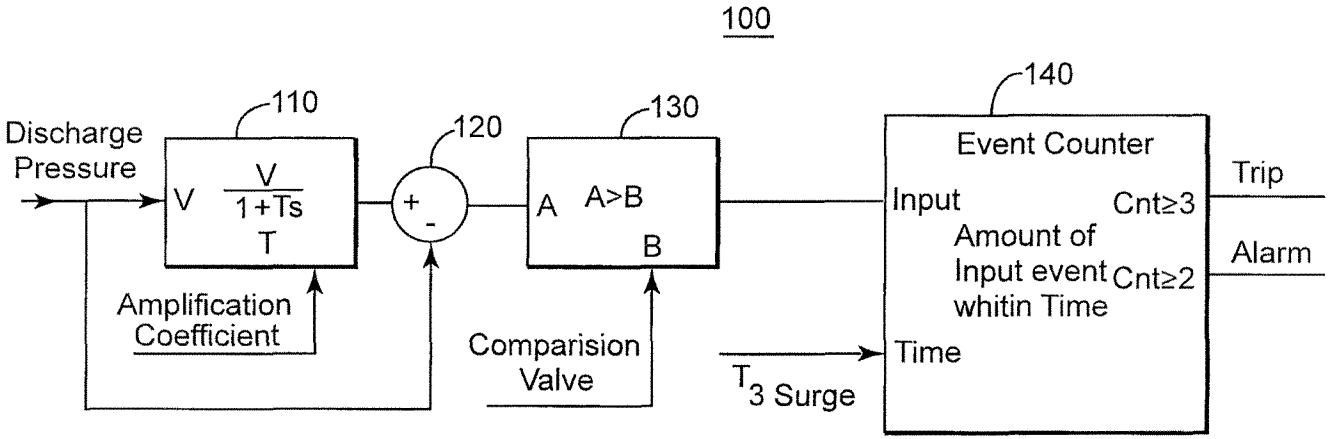
Figure 2 (Background Art)
FIG. 2 is a block diagram of a conventional electronic surge detector.

In contrast with the conventional approach, where the only response to the occurrence of the surge trends was to trip the system (e.g., after three shots for the conventional electronic surge detector in FIG. 2), in some of the methods and systems according to various embodiments described in this section, the surge margin is relocated, which relocation makes another occurrence of a surge event less likely (since the relocated margin is farther from the surge line than the initial surge margin).

Additionally, in contrast with the conventional approach in which only a surge trend is identified (i.e., a surge shot), in some of the methods and systems according to various embodiments, a beginning of a surge event is identified using evolutions of the discharge pressure, the rate of the discharge pressure and the rate of change of the rate, then the discharge pressure is monitored until decreasing below an expected low pressure value, and a reversal of the surge trend is observed when the rate of the discharge pressure becomes positive. Thus multiple features of the patter of the evolution of the discharge pressure are recognized.

Figure 6:
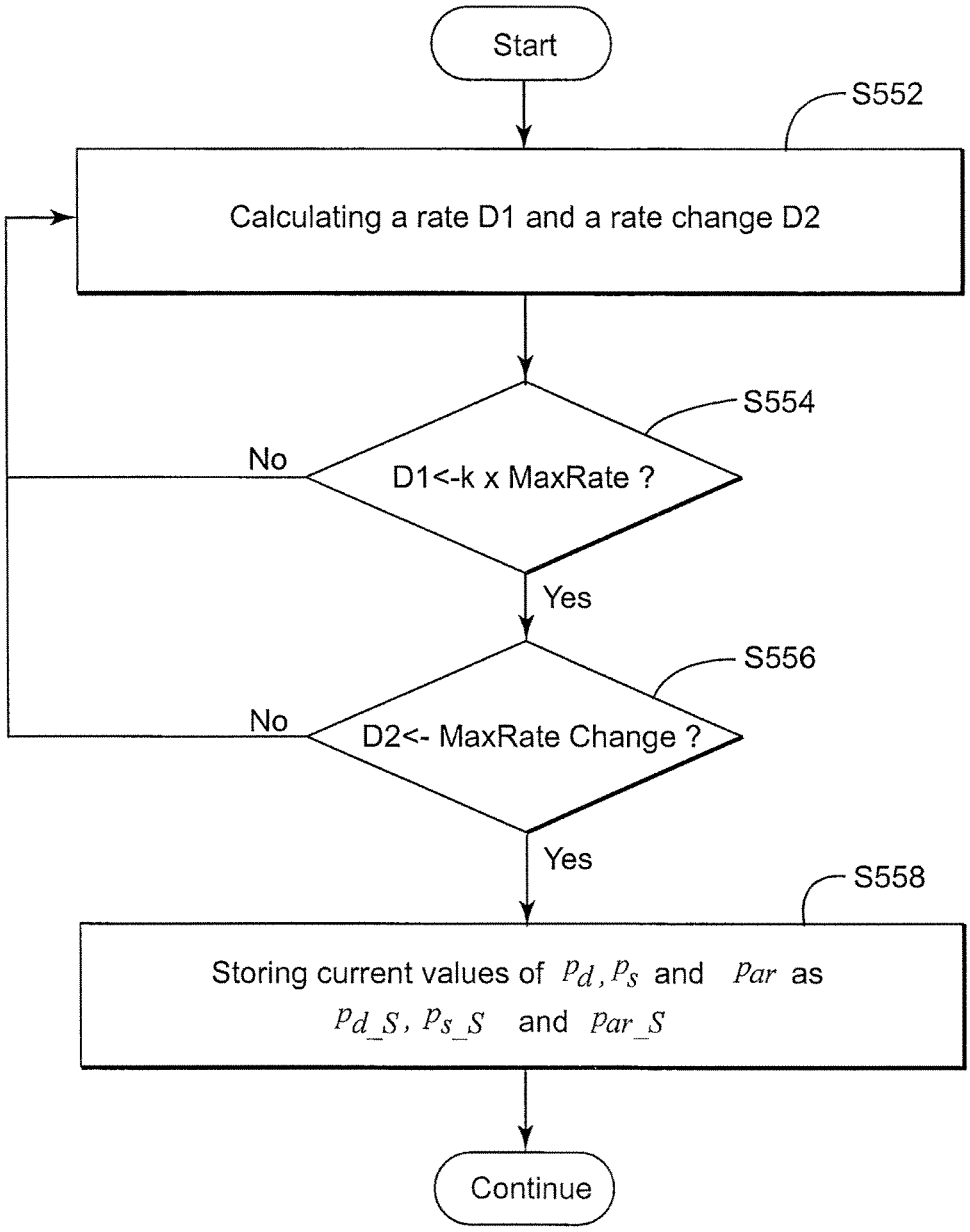
FIG. 6 is a flow diagram of detecting a beginning of a surge event, according to an embodiment.

FIG. 6 is a flow diagram of detecting a beginning of a surge event, according to an embodiment. The steps illustrated in FIG. 6 may be considered a possible implementation of step S510 of the method in FIG. 5. At S552, a rate D1 and a rate change D2 are calculated.

The rate D1 represents a variation of the discharge pressure in time. In one embodiment, the rate D1 may be calculated as the first derivative with respect to time of the discharge pressure. In an alternative embodiment, the rate D1 with a noise reduction first order filter, may be calculated using the Laplace transform of the discharge pressure Pd(s), multiplied by transfer function s/(s+1) so that D1=Pd×s/(s+1).

The rate change D2 represents a variation of the rate D1 in time. In one embodiment, the rate D2 may be calculated as the second derivative with respect to time of the discharge pressure. In an alternative embodiment, the rate change D2 may be calculated using a second order noise reduction filter.

In order to determine whether a surge event is likely to occur, the rate D1 is compared with a fraction k of a maximum rate (MaxRate) at S554 (since the discharge pressure decreases, if k and Max rate are positive values, a minus sign is used). The fraction k and the maximum rate (MaxRate) have predetermined values. For example, the fraction k may be around 60%. When a surge event occurs, the discharge pressure decreases rapidly. If the rate D1 remains larger than the fraction of the maximum rate (the NO branch at S554), the discharge pressure decreases slowly and no surge event is expected.

If the rate D1 is smaller than the fraction of the maximum rate (the YES branch at S554), the rate change D2 is compared with a maximum rate change (MaxRateChange) at S556. As long as the rate change D2 remains larger than (−MaxRateChange), no surge event is expected (the NO branch at S556). The second derivative is used to detect a sudden (i.e., instantaneous) fast drop of D1 which indicates beginning of a surge.

If the rate change D2 exceeds the maximum rate change (the YES branch at S556), a surge event is likely to occur and the current values of the discharge pressure $p_d$, the suction pressure $p_s$ and a surge parameter Par are stored as reference values, $P_d$_F, $P_s$_F and Par_F, at S558.

The surge parameter may be a ratio between the flow through compressor and the flow at which surge is known to occur at same compressor pressure ratio. Based on this definition of the surge parameter, the surge parameter is one on a surge line in a two-dimensional plot of the flow parameter versus the pressure ratio. A surge margin is the value of surge parameter below which anti-surge control opens the anti-surge valve in order to maintain the surge parameter at surge margin value.

Steps S552, S554, S556, and S558 illustrated in FIG. 6 accomplish detecting a beginning of a surge event.

Figure 7:
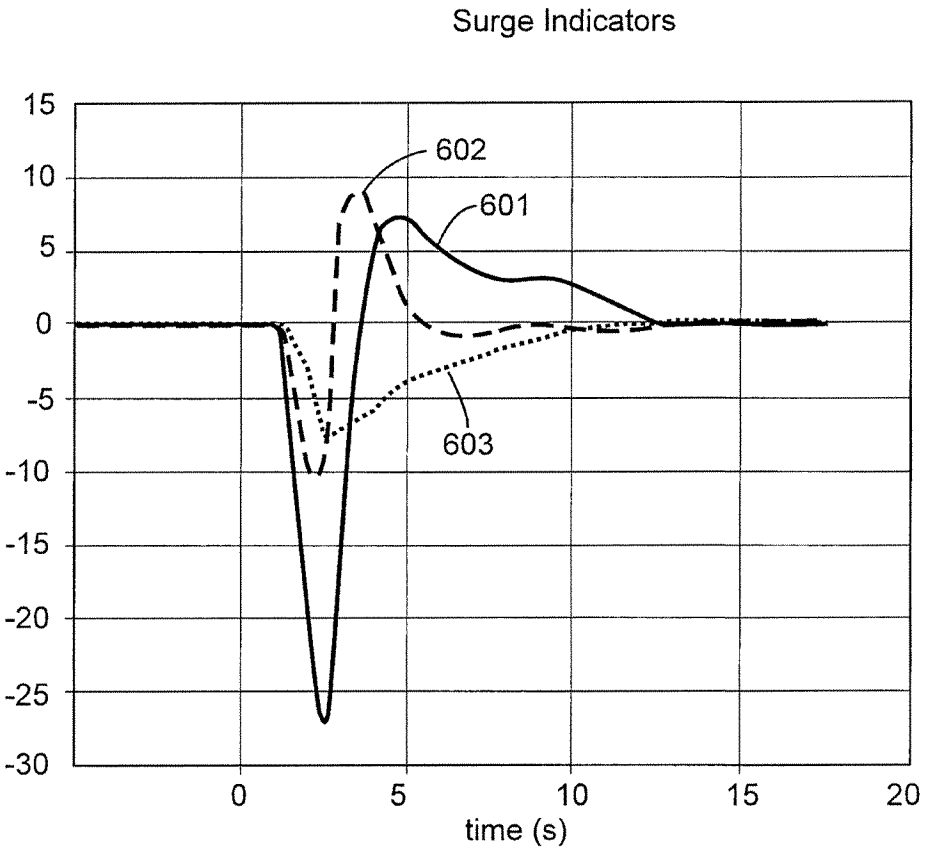
FIG. 7 is a graph representing an evolution of the first derivative of the discharge pressure, the second derivative of the discharge pressure and a deviation of the discharge pressure from an initial value, during a surge event according to an exemplary embodiment.

The manner in which the discharge pressure and its first and second derivatives evolve during a real surge event is illustrated in FIG. 7. Plot line 601 in FIG. 7 represents (in arbitrary units) the first derivative with respect to time of the discharge pressure (i.e., D1 according to one embodiment). Plot line 602 in FIG. 7 represents (in arbitrary units) the second derivative with respect to time of the discharge pressure (i.e., D2 according to one embodiment). Plot line 603 in FIG. 7 represents the deviation of the discharge pressure from a stored value of the initial discharge pressure (in percentages).

Figure 8:
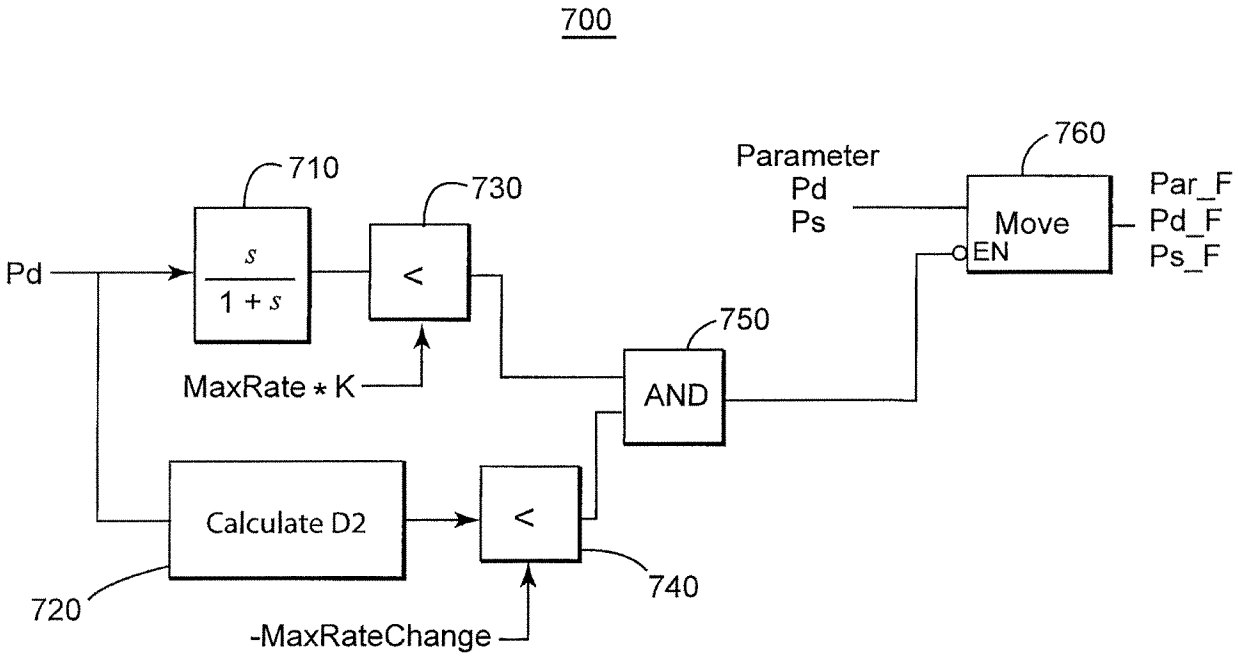
FIG. 8 is a block diagram of an electronic circuit implementing the detecting of a beginning of a surge event, according to an exemplary embodiment.

FIG. 8 is a block diagram of a circuit 700 (electronic, software, hardware or combination thereof) implementing the detecting of a beginning of a surge event according to an embodiment. Blocks 710 and 720 calculate the rate D1 and the rate change D2, respectively, based on input values of the discharge pressure $p_d$. In blocks 730 and 740, the calculated D1 and D2 are compared with a fraction K of the maximum decrease rate (−MaxRate) and a maximum decrease rate change (−MaxRateChange), respectively. If (i) the rate D1 is less than (−K×MaxRate), and (ii) the rate change D2 is less than (−MaxRateChange), the circuit 750 sends a signal to circuit 760 triggering circuit 760 to store current values of the discharge pressure $p_d$, suction pressure $p_s$ and surge parameter Par as reference values $p_d$_F, $p_s$_F and par_F.

Figure 9:
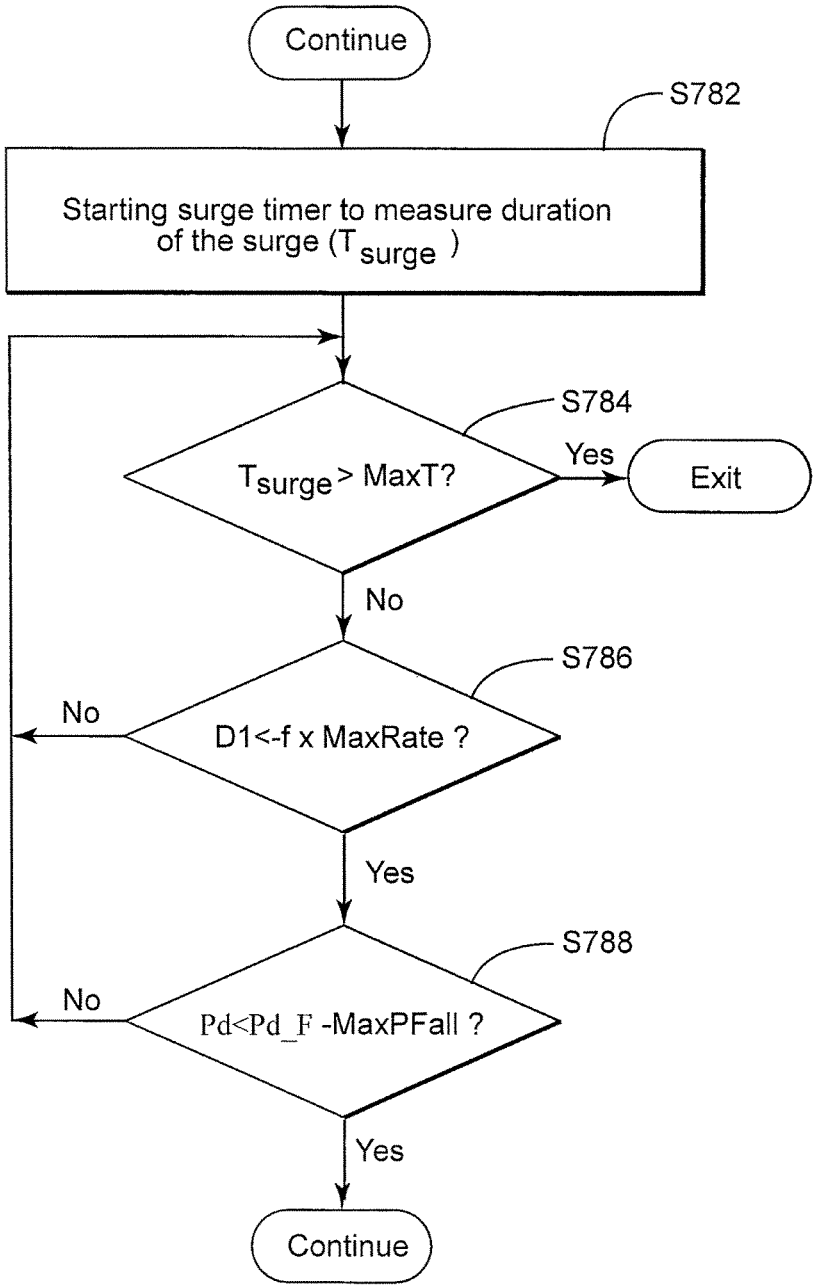
FIG. 9 is a flow diagram of monitoring the discharge pressure decrease, according to an exemplary embodiment.

FIG. 9 is a flow diagram of monitoring the discharge pressure decrease until the discharge pressure becomes lower than a low expected pressure according to an embodiment. The steps illustrated in FIG. 9 may be considered as a possible implementation of step S520 of the method in FIG. 5.

At S782, a timer configured to measure a time ($T_{surge}$) since the beginning of the surge event is started. If a comparison of at S784 shows that the time ($T_{surge}$) since the beginning of the surge event has exceeded a predetermined maximum time (MaxT) (i.e., branch YES at S784), the surge shot is unlikely to follow anymore and, therefore, the surge detection logic is reset. The predetermined maximum time (MaxT) is an estimated maximum duration of a surge event.

If the comparison of at S784 shows that the time since the beginning of the surge event ($T_{surge}$) has not exceeded the predetermined maximum time (i.e., branch NO at S784), the rate D1 is compared with a fraction f of the maximum rate (MaxRate) at S786. Steps S784 and S786 are performed until the rate D1 becomes less than (−MaxRate×f) (i.e., branch YES at S786). The current discharge pressure $p_d$ is then compared with a low expected pressure at S788. The low expected pressure is a difference between the stored value of the discharge pressure $P_d$_F and an expected maximum pressure drop (MaxPFall). The expected maximum pressure drop may be a predetermined fraction g of the difference between the stored value of the discharge pressure $P_d$_F and the stored value of the suction pressure $P_s$_F (e.g., the predetermined fraction g may be 12%).

If the comparison at S788 shows that the discharge pressure is not lower than the low expected value (i.e. branch NO at S788), steps S784, S786 and S788 are performed again within $T_{surge}$<MaxT. If the discharge pressure is lower the low expected value (i.e., branch YES at S788), the monitoring is completed.

Figure 10:
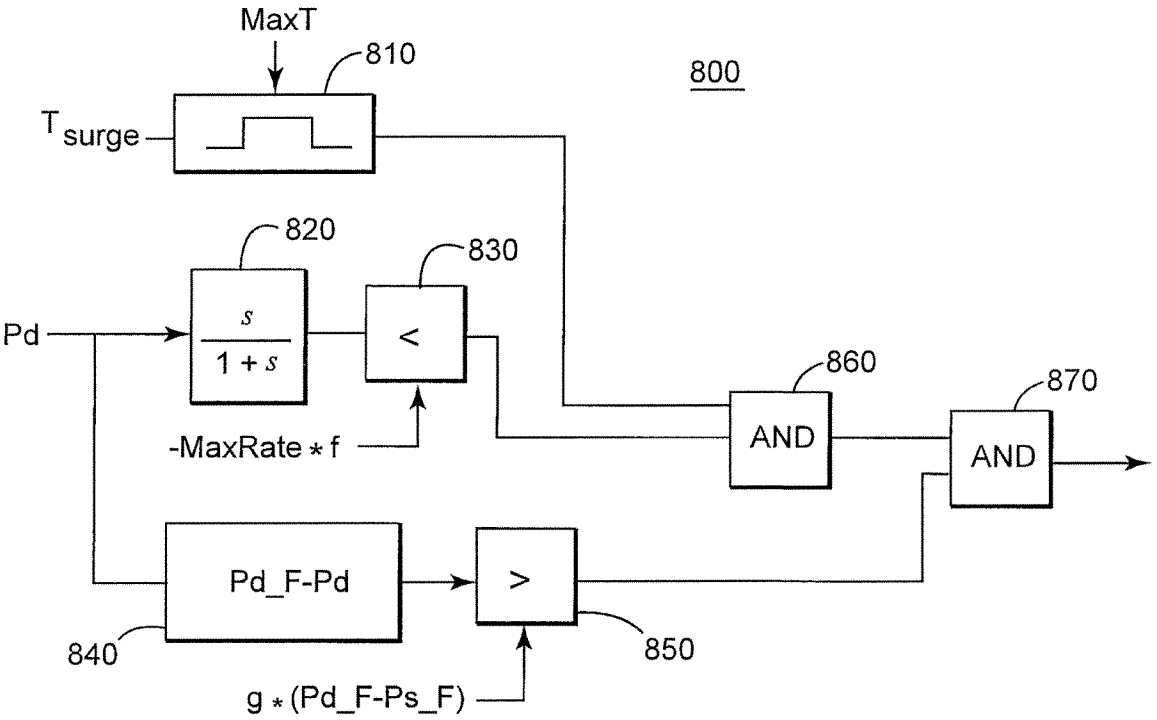
FIG. 10 is a block diagram of an electronic circuit implementing the monitoring of the decreasing discharge pressure, according to an exemplary embodiment.

FIG. 10 is a block diagram of a circuit 800 (electronic, software, hardware or combination thereof) implementing the monitoring of the discharged pressure until the discharge pressure becomes lower than a low expected pressure according to an embodiment. Block 810 measures the time ($T_{surge}$) since the beginning of the surge event and ensures that the time does not exceed a maximum time MaxT. Block 820 calculates the rate D1 based on input values of the discharge pressure $p_d$. For example, D1 may be calculated using the Laplace transform of the discharge pressure $p_d$ ($P_d$(s)) multiplied by a transfer function s/(s+1). In another embodiment, D1 may be calculated as a first derivative with respect to time of the discharge pressure $p_d$.

Block 830 compares the calculated D1 with a fraction f of the maximum decrease rate (−MaxRate). Block 840 calculated a difference between the stored value of the discharge pressure $P_d$_F and the current value of the discharge pressure $p_d$. Block 850 compares the difference calculated by block 840 with a fraction g of a difference between the stored value of the discharge pressure $P_d$_F and the stored value of the suction pressure $P_s$_F. If $T_{surge}$ is less than MaxT and D1 is less than (−f×MaxRate), block 840 receives signals from blocks 810 and 830, and outputs a signal to block 860 and 870. If additionally block 870 receives a signal from block 850 indicating that the difference calculated by block 840 is larger than g×($P_d$_F−$P_s$_F), block 870 outputs a signal indicating completion of monitoring the decrease of the discharge pressure.

Figure 11:
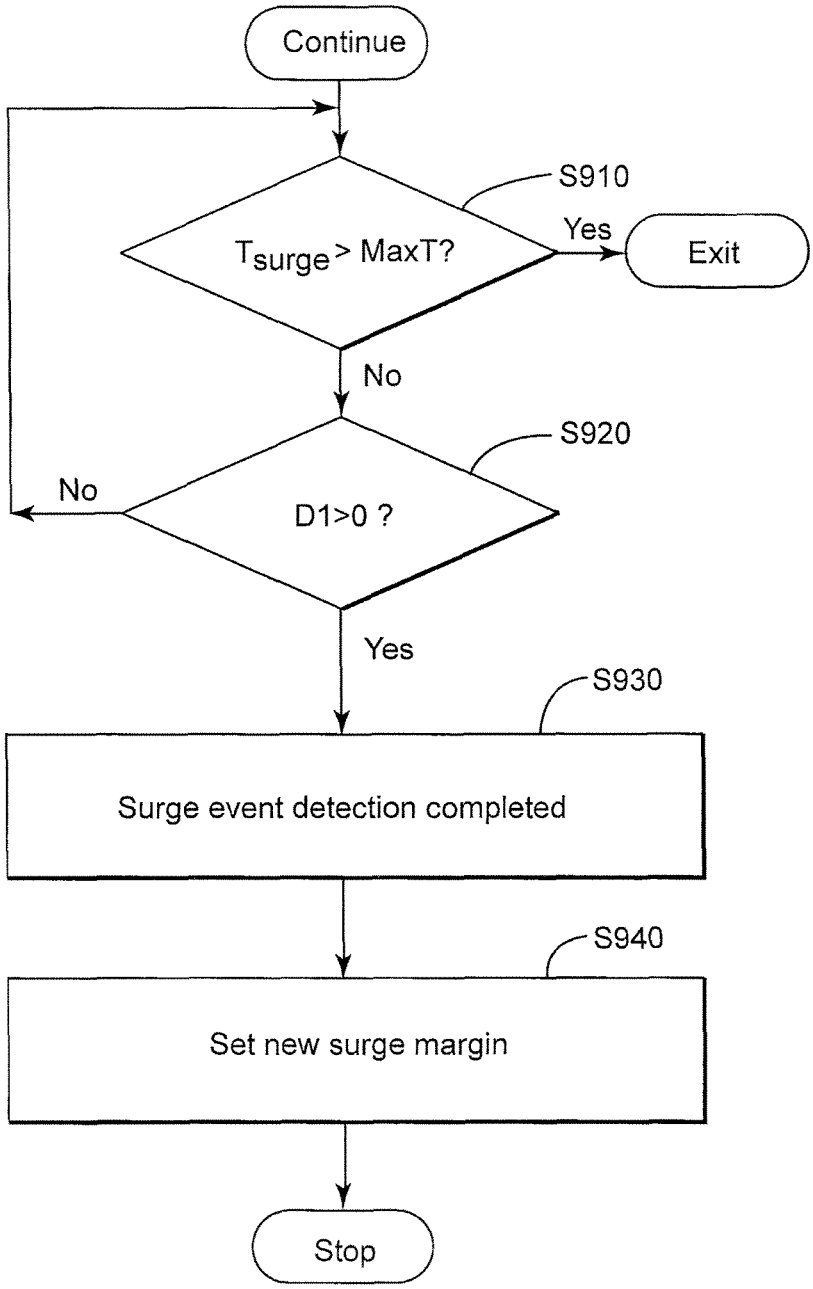
FIG. 11 is a flow diagram of detecting an end of the surge event when the first derivative of the discharge pressure indicates that the discharge pressure increases, according to an exemplary embodiment.

FIG. 11 is a flow diagram of detecting an end of the surge event when the rate D1 indicates that the discharge pressure $p_d$ increases, and setting a new surge margin. The steps illustrated in FIG. 11 may be considered as a possible implementation of steps S530 and S540 of the method in FIG. 5.

Step S910, which is similar to S784, determines whether the time ($T_{surge}$) since the estimated beginning of the surge event has exceeded a maximum time to detect the surge. If S910 determines that the time ($T_{surge}$) since the beginning of the surge event has exceeded the maximum time (i.e., branch YES at S910), the surge detection has lasted longer than a predetermined time considered significant for a surge shot. In this situation, the method ends and the surge detection logic is reset returning to monitor the discharge pressure in order to identify occurrence of a surge trend.

If the time ($T_{surge}$) since the beginning of the surge event has not exceeded a maximum time (i.e., branch NO at S910), step S920 determines whether the rate D1 is positive (i.e., larger than 0). If the rate D1 is positive, the discharge pressure is increasing, which means that the surge event is ending. Completion of the surge event is noted at S930. At S940, a new surge margin is set.

Figure 12:
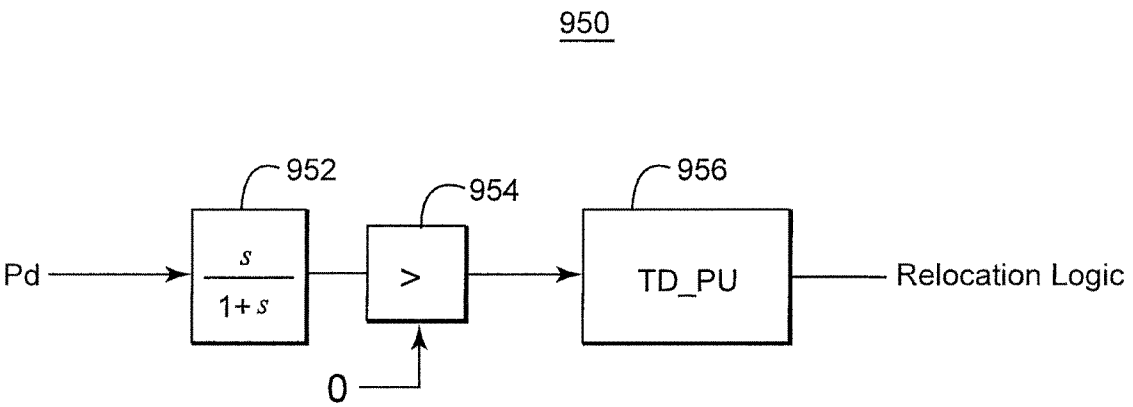
FIG. 12 is a block diagram of an electronic circuit implementing the detecting of the end of the surge event when the first derivative of the discharge pressure indicates that the discharge pressure increases, according to an exemplary embodiment.

FIG. 12 is a block diagram of a circuit 950 (electronic, software, hardware or combination thereof) implementing the detecting of the end of the surge event when the first derivative of the discharge pressure indicates that the discharge pressure increases. Block 952 calculates the rate D1 based on input values of the discharge pressure $p_d$. For example, D1 may be calculated using the Laplace transform of $p_d$ multiplied by the transfer function s/(s+1). If the calculated value of D1 is positive (i.e., larger than 0), block 954 outputs a signal to block 956. Block 956 is a timer which outputs a relocation signal is the signal output by block 954 stays "True" long enough (e.g., 1 second) to ensure that relocating the margin is intended, and does not occur following a mere spike.

Figure 13:
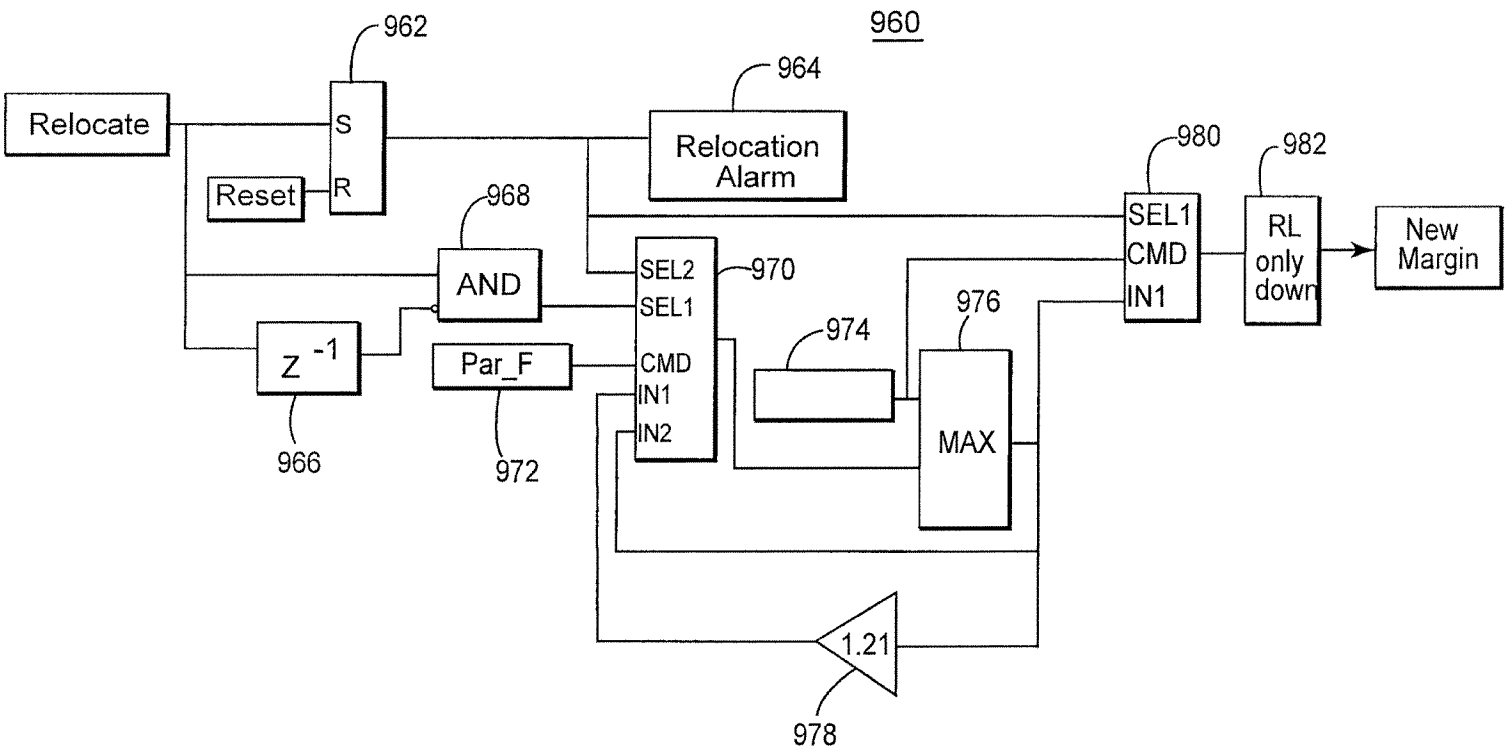
FIG. 13 is a block diagram of an electronic circuit implementing the relocation of the surge margin, according to an exemplary embodiment.

Having detected the end of the surge event, a relocation of the surge margin is discussed next. FIG. 13 is a block diagram of a circuit 960 (electronic, software, hardware or combination thereof) implementing the relocation of the surge margin. The circuit 960 receives a relocate signal output by block 956 in FIG. 12. A flip-flop circuit 962 receiving the relocate signal may trigger issuance of a relocation by block 964. A previous value of the relocating margin stored in block 966 is provided upon receiving the relocation signal by block 968 to a selector 970. The selector 970 also receives the stored value of the surge parameter Par_F from block 972. Block 974 provides a nominal margin to block 976 which ensures that the relocation logic can only increase the margin. Once relocation logic is activated selector 970 selects input 1 for only one scan (sel1 of 970 is a pulse on relocate transition from False to True). For this one scan, the output of selector 970 is the Par_F*1.21 (means 10% of flow more than the surge limit) as shown at reference numeral 978. The following scans, sel1 becomes False but sel2 remains active so that margin calculated at preceding scan is maintained (input 2 of 970).

A second selector 980 receiving as inputs sel1, which is the latched relocation logic bit, CMD, which is the nominal surge margin, and In1, which is the relocated margin, outputs a new surge margin. Block 982 limits the decreasing rate of the new margin to ensure that when relocation logic is reset (e.g. via the R input of the flip-flop circuit 962), the system smoothly operates the anti-surge valve towards the nominal margin stored in block 974, without sudden changes that can yield unstable or damaging transitory states.

Figure 14:
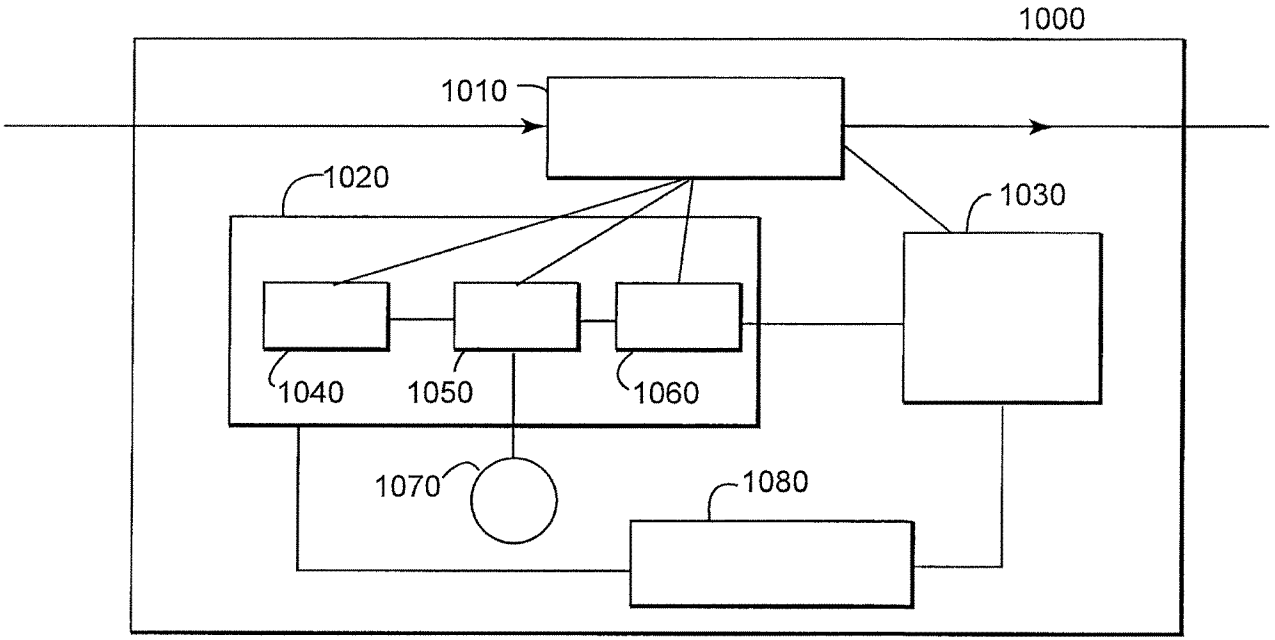
FIG. 14 is a block diagram of a controller according to an exemplary embodiment.

FIG. 14 is a block diagram of a controller 1000 according to another embodiment. The controller 1000 includes an interface 1010 configured to receive values of discharge pressure from a compressor, and to output signals and alarms. The controller 1000 further includes a surge event detection unit 1020 connected to the interface and configured to detect a surge event in the compressor based on evolutions of the discharge pressure, a rate of the discharge pressure and a rate change of the rate. The controller 1000 further includes a surge margin relocation unit 1030 connected to the surge event detection unit 1020 and the interface 1010, and configured to relocate a surge margin relative to a surge parameter value recorded at a beginning of the surge event. An embodiment of the surge margin relocation unit 1030 may be the circuit 960 in FIG. 13.

The surge event detection unit may include a first circuit 1040 connected to the interface 1010 and configured to detect a beginning of the surge event in the compressor based on a rate of the discharge pressure and a rate change of the rate. An embodiment of the first circuit 1040 may be the circuit 700 in FIG. 8.

The surge event detection unit 1020 may further include a second circuit 1050 connected to the first circuit 1040 and the interface 1010, and configured to monitor the discharge pressure the discharge pressure becomes lower than a low expected discharge pressure. An embodiment of the second circuit 1050 may be the circuit 800 in FIG. 10.

The surge event detection unit 1020 may further include a third circuit 1060 connected to the second circuit 1050, the surge margin relocation unit 1030 and the interface 1010, and configured to detect an end of the surge event when the rate of the discharge pressure becomes positive. An embodiment of the third circuit 1060 may be the circuit 950 in FIG. 12.

The surge event detection unit 1020 may further include a timer 1070 and may be configured to output an alarm when the surge event lasts longer than a predetermined time considered safe for the compressor.

The controller 1000 may further include a buffer 1080 connected to the surge event detection unit and the relocation unit, and configured to store values of the discharge pressure, a suction pressure and a surge parameter when the surge event detection unit detects a beginning of the surge event.

Figure 15:
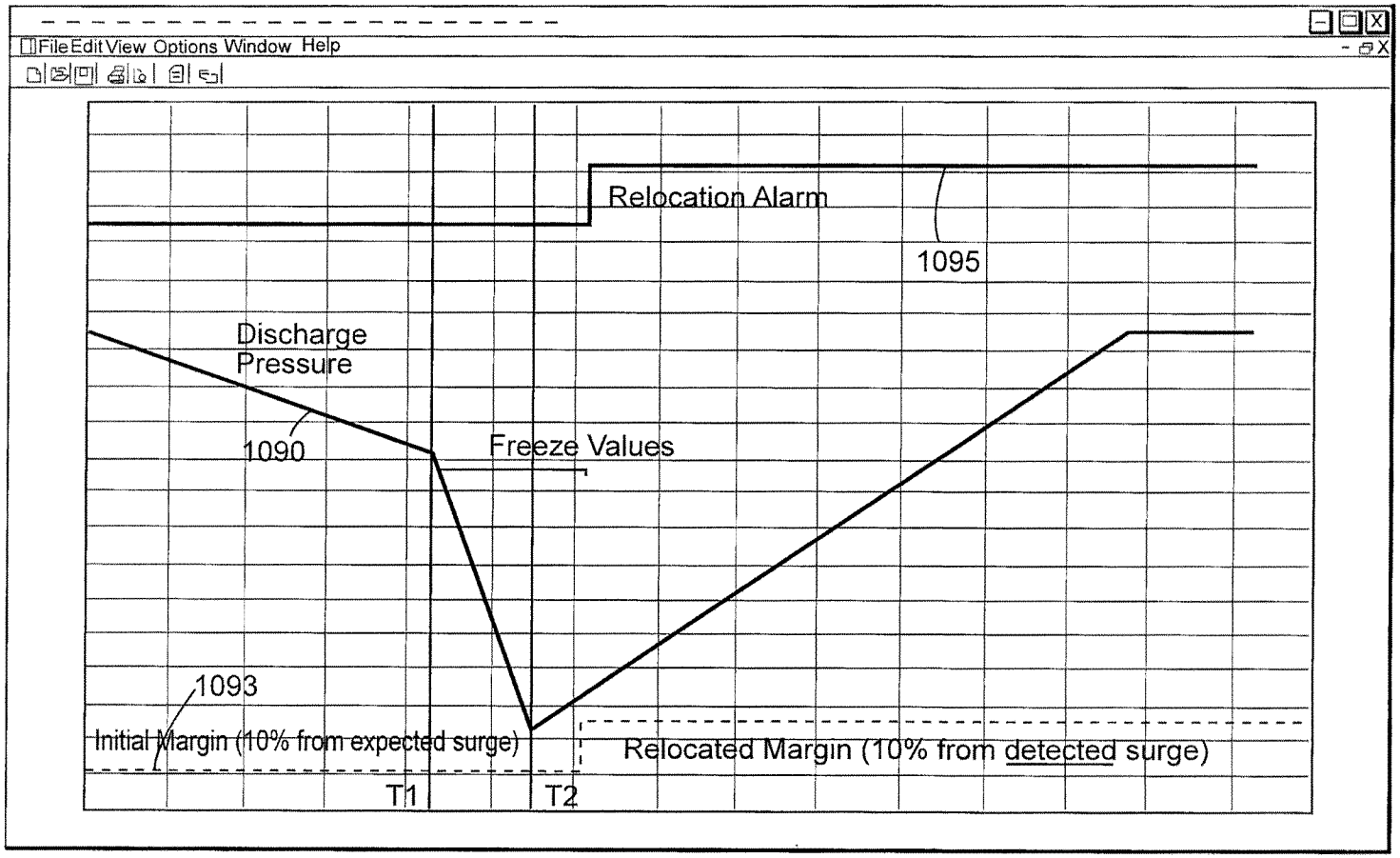
FIG. 15 is a graph illustrating an effect on handling a surge event in a system including a compressor, according to an exemplary embodiment.

FIG. 15 is a graph illustrating the effect of an embodiment on handling a surge event in a system including a compressor. The x axis of the graph represents time. The discharge pressure is represented as line 1090. At T1 a surge event begins and the rate of discharge pressure increases. The embodiment then freezes the current values of the discharge pressure $p_d$, the suction pressure $p_s$ and a surge parameter Par are stored as reference values, $P_d$_F, $P_s$_F and Par_F. According to various embodiments described above, a pattern of the discharge pressure evolution during the discharge event is monitored and when the discharge pressure starts increasing at T2, the embodiments proceed in relocating the surge margin. For example, as illustrated by line 1093 in FIG. 14, if an initial margin was set at 10% from the expected surge, a relocated margin is set at T2 to be 10% from the detected surge. Assuming that the surge event has occurred when the surge parameter had an initial value of 1.1 times a predicted surge value, after setting the new surge margin, after T2 the system operates such as the surge parameter to be no less than 1.21 times the predicted surge value, and, in terms of flow, 1.1 times the initial value (flow is proportional to square root of parameter). Line 1095 in FIG. 15 illustrates a relocation alarm signal.

The above-disclosed exemplary embodiments provide an enhanced identification of the surge events based on recognizing and monitoring a pattern of the discharge pressure in time. When a surge event has been overcome, for example, by modifying a status of the anti-surge valve to alter the fluid flow through the compressor, a surge margin is modified to avoid recurrence of surge events.

Thus, if a surge event occurs, the embodiments provide additional possible responses besides tripping the system. Moreover, information stored based on observing the surge event (e.g., the stored values) are used to adjust parameters (e.g., the surge margin) in order to enhance the system operation. Thus, in contrast to the conventional surge detection that was able only to trip the system, the surge detection according to various embodiments may trigger substantive changes in the manner of operating the system (i.e. change of the surge margin), aimed to prevent occurrence of surge events.

The disclosed exemplary embodiments provide devices and methods for detecting surge events and monitoring a pattern of the discharge pressure during the surge event, followed by relocating a surge margin. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A fluid transport system, comprising:

a compressor configured to increase a pressure of a fluid flow passing therethrough;

an anti-surge flow recirculation loop configured to selectively redirect, using an anti-surge valve, a part of the fluid flow passing through the compressor from a discharge output of the compressor to an input of the compressor; and a controller connected to the anti-surge flow recirculation loop and the compressor, and configured to:

(i) detect a surge event by detecting a beginning of the surge event based on decreasing discharge pressure, the rate of the discharge pressure, and the rate of change of the rate of the discharge pressure in the compressor using a sensor;

(ii) monitor the discharge pressure until the discharge pressure decreases below an expected low discharge pressure value; and then (iii) after the discharge pressure has decreased below the expected low discharge pressure value, detect an end of the surge event when the rate of the discharge pressure becomes positive; and (iv) relocate a surge margin characterizing an operation of the fluid transport system; (v) issue a relocate alarm, when the surge margin is changed.

2. The fluid transport system of claim 1, wherein the surge parameter is related to the fluid flow through the compressor.

3. The fluid transport system of claim 1, wherein the controller is configured to detect the surge event based on the evolution of the discharge pressure of the fluid flow exiting the compressor, and of a rate of the discharge pressure.

4. The fluid transport system of claim 1, wherein the controller includes a timer and is configured to monitor the evolution of the discharge pressure using the timer for a predetermined time, and to reset a search for the surge event after the predetermined time has elapsed if the surge event has not been detected.

5. The fluid transport system of claim 1, wherein the controller issues a relocate alarm, when the surge margin is changed.

6. The fluid transport system of claim 1, wherein the controller is configured to relocate the surge margin by requiring the fluid transport system to be operated such that a surge parameter relative to which the surge margin is defined to remain 10% larger than the surge parameter value recorded at the beginning of the surge event.

7. A method for a fluid transport system including a compressor, the method comprising:

detecting a beginning of a surge event based on a rate of a discharge pressure of the compressor and a rate change of the rate of the discharge pressure;

after the beginning of the surge event, monitoring the discharge pressure until the discharge pressure decreases below an expected low discharge pressure value;

after the discharge pressure has decreased below the expected low discharge pressure value, detecting an end of the surge event when the rate of the discharge pressure becomes positive; and after the end of the surge event, relocating a surge margin based on a surge parameter value recorded at the beginning of the surge event.

8. The method of claim 7, further comprising:

relocating the surge margin by requiring the fluid transport system to be operated such that a surge parameter relative to which the surge margin is defined to be 10% larger than a value of the surge parameter recorded at a beginning of the detected surge event.

9. The method of claim 7, wherein the surge parameter value is related to the fluid flow through the compressor.

10. The method of claim 7, further comprising detecting the surge event based on the evolution of the discharge pressure of the fluid flow exiting the compressor, and of a rate of the discharge pressure.

11. The method of claim 7, further comprising a controller having a timer the configured to monitor the evolution of the discharge pressure using the timer for a predetermined time, and to reset a search for the surge event after the predetermined time has elapsed if the surge event has not been detected.

12. The method of claim 11, wherein the controller issues a relocate alarm when the surge margin is changed.

13. The method of claim 7, further comprising relocating the surge margin by requiring the fluid transport system to be operated such that a surge parameter relative to which the surge margin is defined to remain 10% larger than the surge parameter value recorded at the beginning of the surge event.

14. A controller comprising:

an interface configured to receive values of a discharge pressure from a compressor, and to output signals and alarms;

a surge event detection unit connected to the interface and configured to detect a surge event in the compressor by monitoring the discharge pressure with a sensor, a rate of the discharge pressure and a rate change of the rate of discharge pressure; the surge event detection unit being further configured to:

(i) detect a surge event by detecting a beginning of the surge event based on decreasing discharge pressure, the rate of the discharge pressure, and the rate of change of the rate of the discharge pressure in the compressor using a sensor;

(ii) monitor the discharge pressure until the discharge pressure decreases below an expected low discharge pressure value; and (iii) after the discharge pressure has decreased below the expected low discharge pressure value, detect an end of the surge event when the rate of the discharge pressure becomes positive;

a surge margin relocation unit connected to the surge event detection unit and the interface, and configured to relocate a surge margin relative to a surge parameter value recorded at a beginning of the surge event, after the surge event detector detects a pattern of a surge event in the evolutions;

and issues a relocate alarm when the surge margin is changed.

15. The controller of claim 14, wherein the surge margin relocation unit is configured to relocate the surge margin by requiring a fluid transport system to be operated such that a surge parameter relative to which the surge margin is defined to be 10% larger than a value of the surge parameter recorded at a beginning of the detected surge event.

16. The controller of claim 14, wherein the surge parameter is related to the fluid flow through the compressor.

17. The controller of claim 14, wherein the controller is configured to detect the surge event based on the evolution of the discharge pressure of the fluid flow exiting the compressor, and of a rate of the discharge pressure.

18. The controller of claim 14, wherein the controller includes a timer and is configured to monitor the evolution of the discharge pressure using the timer for a predetermined time, and to reset a search for the surge event after the predetermined time has elapsed if the surge event has not been detected.

* * * * *